US009285197B2

(12) United States Patent
Reid

(10) Patent No.: US 9,285,197 B2
(45) Date of Patent: Mar. 15, 2016

(54) DISPOSAL OF MUNITIONS

(71) Applicant: DISARMCO HOLDINGS LIMITED, Southend on Sea, Essesx (GB)

(72) Inventor: John Nicholas Reid

( * ) Notice: Subject to any disclaimer, the term of this patent is extended or adjusted under 35 U.S.C. 154(b) by 0 days.

(21) Appl. No.: 14/431,429

(22) PCT Filed: Oct. 2, 2013

(86) PCT No.: PCT/IB2013/059071

§ 371 (c)(1),
(2) Date: Mar. 26, 2015

(87) PCT Pub. No.: WO2014/054008

PCT Pub. Date: Apr. 10, 2014

(65) Prior Publication Data

US 2015/0241187 A1 Aug. 27, 2015

(30) Foreign Application Priority Data

Oct. 2, 2012 (GB) ..... 1217580.1

(51) Int. Cl.
*F42B 33/06* (2006.01)

(52) U.S. Cl.
CPC ..... *F42B 33/06* (2013.01)

(58) Field of Classification Search
CPC ..... F42B 33/06; F42B 33/062; F42B 33/065; F42B 33/067; F42D 5/04; F42D 5/045
USPC ..... 86/49, 50
See application file for complete search history.

(56) References Cited

U.S. PATENT DOCUMENTS

| | | | | | |
|---|---|---|---|---|---|
| 5,115,707 | A * | 5/1992 | Kutzli | F42B 30/08 | 102/439 |
| 5,789,695 | A * | 8/1998 | Scherer | F42B 33/06 | 86/1.1 |
| 6,559,413 | B1 * | 5/2003 | Muenchausen | B23K 26/123 | 219/121.72 |
| 2003/0010183 | A1 * | 1/2003 | Reid | B24C 1/045 | 86/50 |

FOREIGN PATENT DOCUMENTS

| | | | | |
|---|---|---|---|---|
| DE | 42 21 666 | C1 | 1/1994 | |
| DE | 4227932 | A1 * | 2/1994 | B23B 1/00 |
| DE | 10245512 | B3 * | 2/2004 | F42B 33/06 |
| DE | 102004034784 | A1 | 2/2006 | |
| FR | 2894660 | | 6/2007 | |
| UA | 68645 | A | 8/2004 | |

* cited by examiner

*Primary Examiner* — Joshua Freeman
(74) *Attorney, Agent, or Firm* — Shalom Wertsberger; Saltamar Innovations

(57) ABSTRACT

A method is described for safely opening the shell of a munition (10) having an inner chamber containing an explosive material. The method comprises the steps of machining a groove (20) into the shell along a parting line that encircles the outer surface of the munition and divides the shell into two parts. The groove (20) is of sufficient depth to weaken the shell but not to penetrate into the inner chamber of the munition. After machining the groove (20), the shell is cracked open by prising the two parts of the shell apart by inserting a suitable implement into the groove.

13 Claims, 1 Drawing Sheet

DISPOSAL OF MUNITIONS

FIELD OF THE INVENTION

The present invention relates to the disposal of munitions and in particular to the opening of the shell of a munition so that the explosive material contained within it may be removed for safe destruction.

BACKGROUND OF THE INVENTION

It has previously been proposed to cut through the shell of a munition in order that its contents may be removed. One known method is to cut through the munition at its point of maximum girth using either a metal cutting implement or a water jet. Even when a metal cutting implement is used, the implement is normally lubricated with water and inevitably water comes into contact with the explosive material during the course of opening the shell and the water becomes contaminated.

Water that is contaminated with explosive material, referred to as pink water, cannot safely be allowed to flow into drains or into nearby rivers and itself presents a disposal problem.

DE 42 21 666 discloses a method of opening a munition that involves partially cutting through the shell of the munition using a compressed water jet to leave a very thin residual wall thickness and then applying shearing or bending forces to perform the final separation to crack open the shell of the munition. If the water jet is directed radially, the depth of the cut made by the water jet cannot readily be determined. Instead, therefore, DE 42 21 666 aims the jet tangentially, as illustrated in FIG. 1 of the patent.

It is however difficult to penetrate the wall of the munition to an accurate depth because the point of impact of the jet is distant from the tip of the nozzle. If one errs on the safe side and leaves a considerable thickness of metal behind at the end of the water jetting, then it is difficult to crack open the munition. If, on the other hand, one aims to leave a very small thickness of metal behind, then one risks, from time to time, penetrating the wall of the munition and producing pink water.

OBJECT OF THE INVENTION

The present invention seeks therefore to provide a method of opening a munition shell that does not create pink water yet does not risk creating sparks and detonating the explosive material contained within the shell.

SUMMARY OF THE INVENTION

In accordance with the present invention, there is provided a method of opening the shell of a munition having an inner chamber containing an explosive material, the method comprising the steps of machining a groove into the shell along a parting line that encircles the outer surface of the munition and divides the shell into two parts, the groove being of sufficient depth to weaken the shell but not to penetrate into the inner chamber of the munition, and cracking open the shell by prising the two parts of the shell apart at the groove.

In contrast to the teaching of DE 42 21 666, the present invention proposes machining the shell wall to create a groove. In other words the invention uses a machine tool rather that water to create a groove. As machine tools are fed radially towards the centre of the shell and are always perpendicular to the shell surface, the groove depth can be determined with greater accuracy.

DE 42 21 666 needs also to make the assumption that the wall thickness of the shell is uniform, but this may not always prove to be the case. For example, if the shell is made of metal cast in a sand mould, one cannot be certain that the core of the mould was positioned centrally with high precision, which would result in the wall thickness being greater on one side than on the other. One also cannot be sure that the inner and outer walls of the shell are perfectly cylinders, especially if the shells are rusty or if they have been subjected to stresses during transportation and storage.

To allow for irregularities such as these, in one embodiment of the invention, the thickness of the shell at all points on the parting line is determined ultrasonically prior to commencement of machining and the remaining depth of material is determined during machining by subtracting a measured depth of the machined groove from the previously measured thickness of the shell.

The wall thickness measurement is most conveniently performed ultrasonically, but any other suitable technique, such as using X-rays, may be adopted in alternative embodiments of the invention.

The depth of the machined groove may be determined using a depth gauge (as used in measuring tyre treads) or from the measured position of the machine tool holder.

In some embodiments, the thickness of the shell remaining between the machined groove and the inner chamber is measured ultrasonically during machining of the groove.

The risk of detonating the explosive material is avoided in the present invention by virtue of the fact that the cutting tool does not penetrate into the inner chamber during the machining of the shell. There is therefore no risk of the explosive material being ignited by the sparks generated during the machining. Furthermore, any water used for lubrication and/or cooling during the machining does not mix with the explosive material and generate pink water.

A shell conventionally has a cylindrical wall with a tapered cone at one end and a flat or slightly dished base at the other which together enclose an inner chamber filled with the explosive material. When opening a shell of this shape, it is preferred to position the parting line to coincide with the junction between the base and the cylindrical wall of the shell rather than the region of maximum girth of the cylindrical wall.

By performing the cutting operation at the base of the shell, no explosive material can be stored in the base that is cut off as the shape of the base prevents it from acting as a receptacle.

The positioning of the groove at the junction between the base and the cylindrical wall of the shell is also important in that it reduces the risk of sharp burrs, which should be avoided, especially on the cylindrical wall of the shell.

The greater the thickness of material that is left behind after machining of the groove, the less is the risk of accidentally penetrating the inner chamber but the greater will be the force required to prise the two parts of the shell apart. In practice, a compromise is reached in selecting the thickness of material remaining on the parting line after machining so that, allowing for measuring and machining tolerances, all risk of the inner chamber being penetrated is avoided, but the parts can still readily be prised apart using a suitable implement. In practice, it has been found that if one aims to leave behind a thickness of approximately 0.5 mm, the shell can be reliably cracked open without risk of penetration of the shell wall during machining.

The prising of the parts of the cylindrical wall of the shell apart after a groove has been machined may be carried out by inserting an implement into the groove. The implement may be designed to be twisted within the groove or it may act as a wedge driven radially into the groove. As a further alternative, it is possible to apply a force to cause the munition shell to shear in the plane of the groove.

The shape of the groove machined into the shell will depend on the design of the implement used to prise the parts of the shell apart. In particular, the groove may either have parallel sides if the implement is to be twisted in the groove or at least one side may be cut at an angle to the plane normal to the axis of the shell if a wedge is to be driven radially into the groove.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

Figure 1:
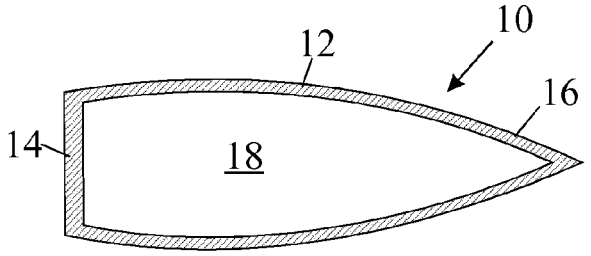
FIG. 1 is a schematic section through a munition shell.

A typical munition shell 10, as shown in section in FIG. 1, has a generally cylindrical outer wall 12, a tapering nose 16 and a flat base 14. The shell is hollow and has an inner chamber 18 filled with an explosive material. The cylindrical wall 12 has a wider girth near its centre than at its base.

The conventional manner of disposing of such a munition is to start by cutting open the shell and this is done by sawing through the wall of the shell at its point of maximum girth. This produces two shell parts both containing explosive. The two parts are emptied of explosive and the metal parts of the shell can then be recycled. The explosive can be destroyed by burning it, an operation that can be performed safely if the explosive is first suitably shredded.

As earlier described, regardless of the method used to cut through the shell wall, this results in the creation of pink water, which itself presents a disposal problem.

Figure 2:
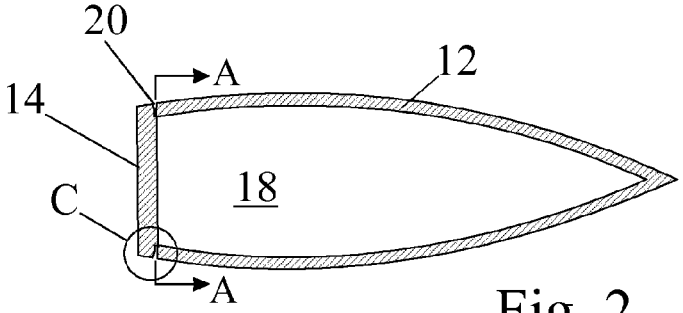
FIG. 2 is a similar section to that of FIG. 1 showing the shell after a groove has been machined adjacent the base.
Figure 3:
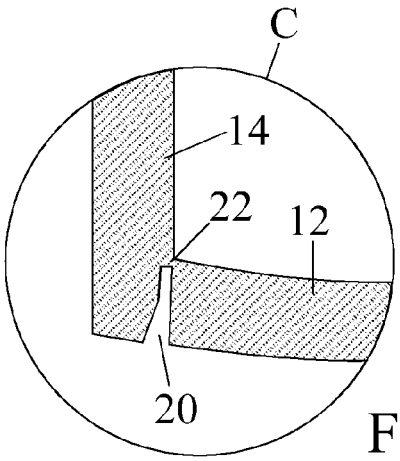
FIG. 3 shows to an enlarged scale the part contained with the circle C in FIG. 2.
Figure 4:
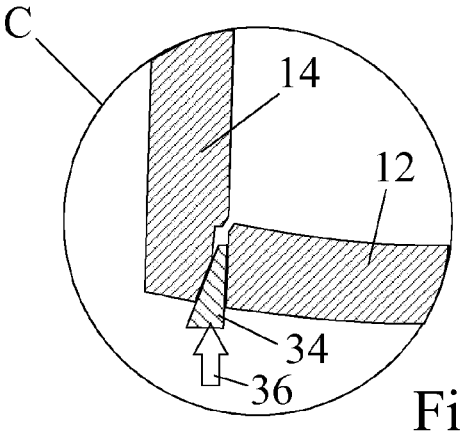
FIG. 4 shows the same view as FIG. 3 as the shell parts are being prised apart.

In the illustrated embodiment of the invention, a parting line is located ultrasonically that lies in a plane at or near where the base 14 meets the cylindrical wall 12. The thickness of the shell wall along this parting line is then accurately measured around the entire perimeter of the shell. Next, the shell is machined, as shown in FIGS. 2 to 4, to form a groove 20 on the parting line. The depth of the groove is selected so that, as shown in FIG. 3, the shell wall is not penetrated but the remaining thickness 22 of material is sufficiently small to allow the base 14 to be prised off the end of the cylindrical wall 12 of the shell.

Figure 5:
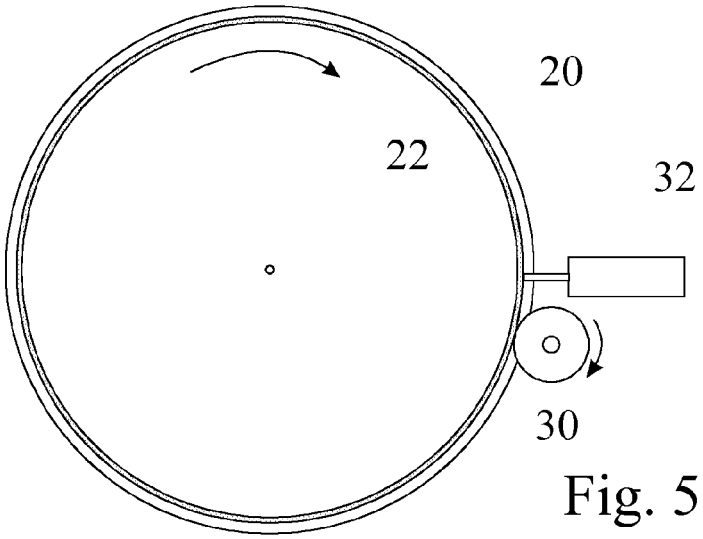
FIG. 5 is a section in the plane A-A of FIG. 2 taken during the machining of the groove.

FIG. 5 shows the groove 20 being machined by means of a rotary implement 30, which may for example be a milling cutter. As the groove is being machined a depth gauge 32 is used to measure its depth to allow the remaining thickness of the metal to be calculated.

As an alternative, to measuring the thickness prior to commencement of machining and subtracting the measured depth of the machine grove, an ultrasonic gauge may be used to measure the remaining thickness 22 of metal beneath the groove 20 as the groove is being machined. EP 1836487 discloses an ultrasonic depth gauge in which ultrasound is guided by, and travels along, a water jet. Such a gauge may be used in the embodiment of FIG. 5 to allow the remaining depth of material to be measured by ultrasound travelling along a liquid jet used for lubrication and cooling.

Once a groove of the desired depth has been formed, it remains only to crack the shell open. One can form the groove with parallel sides and separate the base 14 from the cylindrical wall 12 by inserting a flat screwdriver-like implement into the groove and twisting it. Alternatively, as shown in FIG. 4, one may form the groove with mutually inclined sides and drive a wedge-like implement 34 into the groove 20. The implement 34 may comprise a set of radially tapering collets that are squeezed in the direction of the arrow 36 to cause the shell to crack open without risk of creating sparks.

As a still further possibility, it is possible to apply a force to cause the shell to shear in the plane of the groove without inserting any implement into the groove.

When the base 14 comes away from the cylindrical wall 12, any adhering explosive can be wiped off the flat or dished face of the base. The wax-like explosive material need only then be removed from the cylindrical wall 12 and the nose 16.

An advantage of opening the shell in the manner described is that it is possible to avoid sharp burrs on the shell or the base, which can cause problem during subsequent processing to empty the explosive material from the cylindrical part of the shell.

The method of the invention can be used to open munitions where the outer surface of the shell is rusty or where the shell has walls of uneven thickness. It is not necessary to rotate the shell continuously to carry out the machining of the groove. One could for example provide a ring to roll around the outer surface of the shell that carries an ultrasonic gauge and a milling cutter. The gauge can be used to determine the thickness of the shell wall at each point on the circumference and the cutter can then be set to remove metal down to a suitable depth.

The invention claimed is:

1. A method of opening a shell of a munition having an inner chamber containing an explosive material, the method comprising the steps of:

machining a groove into the shell along a parting line that encircles an outer surface of the munition and divides the shell into two parts, the groove being of sufficient depth to weaker the shell but not to penetrate into the inner chamber of the munition;

cracking open the shell by prising the two parts of the shell apart at the groove; and measuring the thickness of the shell on a parting line utilizing one of ultrasound and X-rays prior to machining to avoid the machined groove penetrating into the inner chamber of the munition.

2. The method of claim 1, wherein the step of measuring the thickness of the shell along the parting line is performed of the whole of the parting line prior to commencement of machining and the depth of material remaining is determined during machining by subtracting a measured the depth of the machined groove from the previously measured thickness of the shell.

3. The method of claim 1, wherein the thickness of the shell remaining between the machined groove and the inner chamber is measured ultrasonically during machining of the groove.

4. The method of claim 1, for opening a shell having a cylindrical wall with a tapered cone at one end and a flat base at the other which together enclose the inner chamber filled with the explosive material, wherein the parting line is positioned to coincide with the junction between the base and the cylindrical wall of the shell.

5. The method of claim 1, wherein the step of cracking open the shell is carried out by inserting a flat implement into the groove and twisting the implement.

6. The method of claim 5, wherein the groove is machined with parallel sides.

7. The method of claim 1, wherein the step of cracking open the shell is carried out by driving a wedge-like implement radially into the groove.

8. The method of claim 1, wherein the groove is machined with mutually inclined sides.

9. A method of opening a shell of a munition having an inner chamber containing an explosive material, the shell having a cylindrical wall with a tapered cone at one end and a flat base at the other, the wall, cone and base enclosing the inner chamber, the method comprising the steps of:

machining a groove into the shell along a parting line that encircles an outer surface of the munition, the groove being of sufficient depth to weaken the shell but not to penetrate into the inner chamber of the munition;

cracking open the shell by prising the two parts of the shell apart at the groove;

wherein the parting line is positioned to coincide with the junction between the base and the cylindrical wall of the shell, the method further comprising the step of measuring the thickness of the shell at a plurality of points on the parting line, in order to determine a safe depth to which the groove may be machined without penetrating the inner chamber of the munition.

10. A method as claimed in claim 9, wherein the step of measuring is performed utilizing an ultrasound.

11. A method as claimed in claim 9, wherein the step of measuring is carried out utilizing an x-ray.

12. A method as claimed in claim 11, wherein the measurement of the thickness of the shell at the plurality of points on the parting line is performed prior to commencement of the step of machining and the remaining depth of material during machining is determined by subtracting a measured depth of the machined groove from the previously measured thickness of the shell.

13. A method as claimed in claim 9, wherein the thickness of the shell remaining between the machined groove and the inner chamber is measured during machining of the groove.

* * * * *